United States Patent [19]

Black

[11] 4,253,135

[45] Feb. 24, 1981

[54] LAMP

[76] Inventor: John O. Black, 9607 Sturgeon Valley Rd., Vanderbilt, Mich. 49795

[21] Appl. No.: 86,266

[22] Filed: Oct. 19, 1979

[51] Int. Cl.[3] ..... F21V 21/02

[52] U.S. Cl. ..... 362/249; 362/311; 362/367

[58] Field of Search ..... 362/217, 218, 222, 223, 362/224, 225, 249, 311, 367, 410, 411, 412, 414, 413, 432, 433, 235, 236, 237, 240

[56] References Cited

U.S. PATENT DOCUMENTS

| | | | |
|---|---|---|---|
| 2,255,433 | 9/1941 | Moss | 362/223 |
| 2,718,587 | 9/1955 | Charleston | 362/222 |
| 2,792,491 | 5/1957 | Rand | 362/410 |
| 2,829,242 | 4/1958 | Koch | 362/412 |
| 3,365,571 | 1/1968 | Koziol | 362/367 |
| 4,117,533 | 9/1978 | Hagelthorn | 362/367 |

*Primary Examiner*—L. T. Hix
*Assistant Examiner*—Alan Mathews
*Attorney, Agent, or Firm*—Harness, Dickey & Pierce

[57] ABSTRACT

The lamp of the present invention has a central core that provides one to four faces for the support of illuminating units. The central core is made up of four elongated substantially square core members which are spaced from each other by interfitting cross members to which the base and top plates of the illuminating units are secured. The complete lamps may be mounted one above the other, suspended on a chain, or supported on a base or pedestal to provide satisfactory illumination. Each illuminating unit has a socket which supports a bulb which is enclosed between bottom and top plates by a U-shaped translucent element.

2 Claims, 8 Drawing Figures

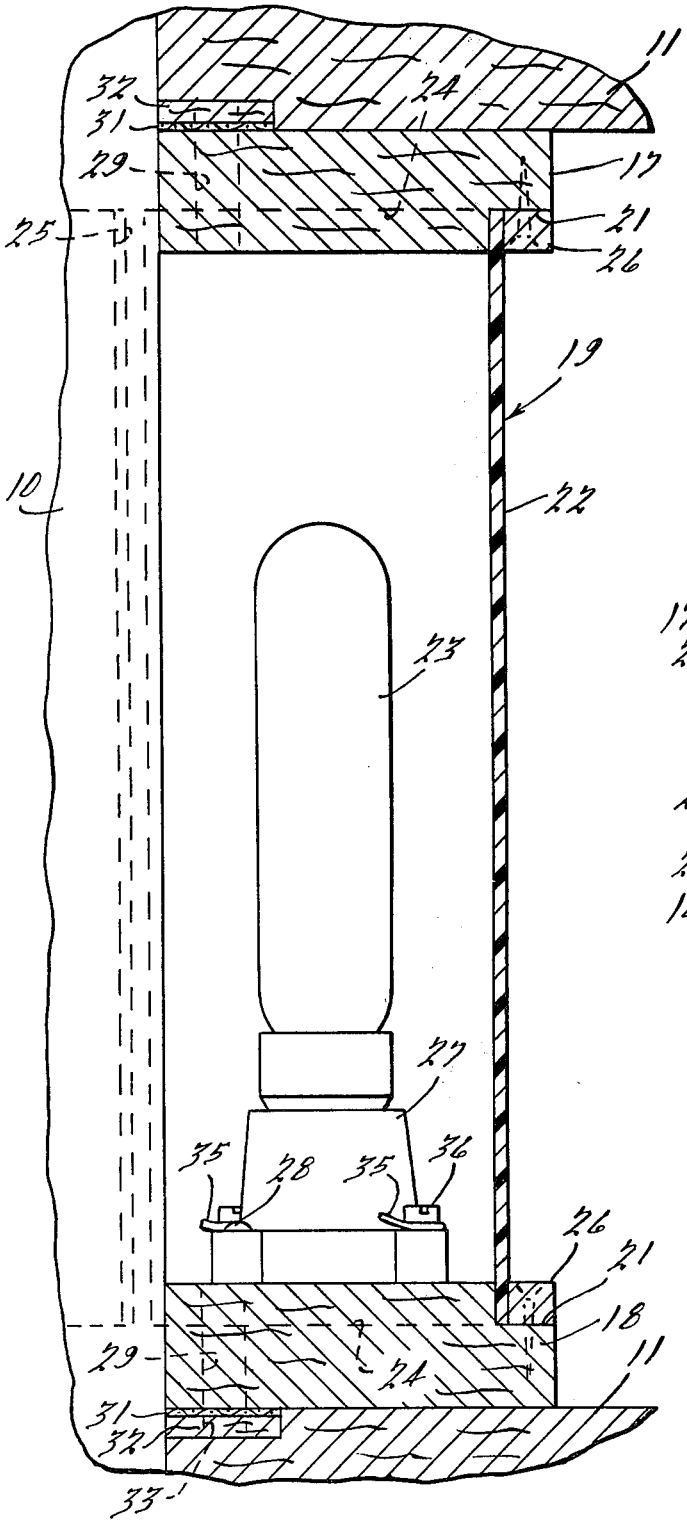
FIG. 3.
FIG. 4.
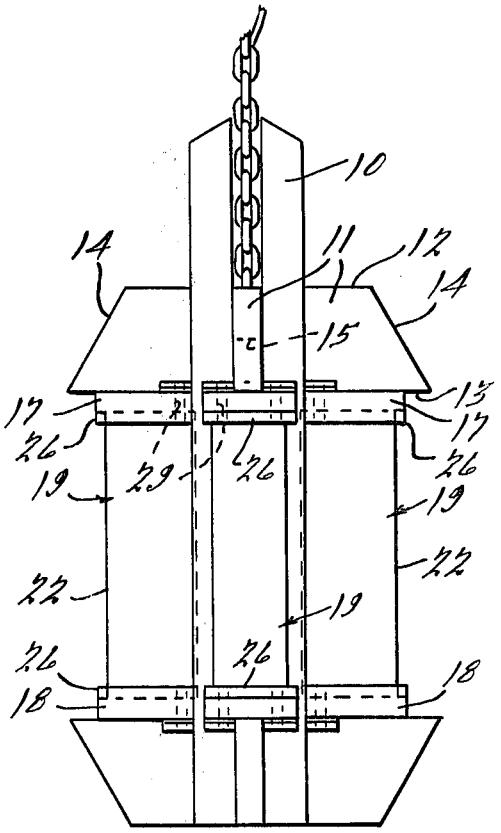
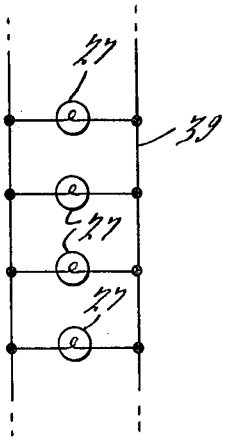
FIG. 5.

LAMP

SUMMARY OF THE INVENTION

The invention pertains to a lamp made of wood which has a central core constructed from four square lengths of wood which are spaced apart by cross members. Illuminating units are secured to the four faces of the core. The illuminating units have U-shaped covers.

BRIEF DESCRIPTION OF THE DRAWINGS

FIG. 3 is an enlarged sectional view of the structure illustrated in FIG. 2, taken on the line 3—3 thereof;

FIG. 4 is a view of a lamp suspended from a chain to form a swag type of lamp;

FIG. 8 is a schematic line diagram showing the parallel wiring arrangement of the illuminating units.

DESCRIPTION OF THE PREFERRED EMBODIMENTS

Figure 1:
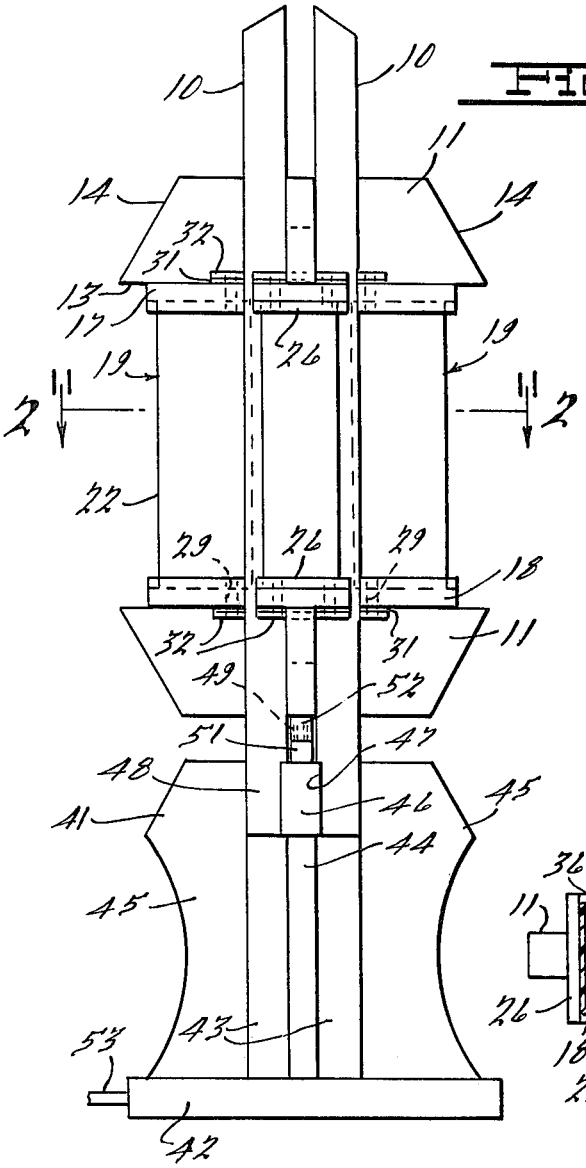
FIG. 1 is a view of the lamp mounted on a base with the electric circuit connected by engageable plugs mounted in the central area of a plurality of illuminating units.
Figure 2:
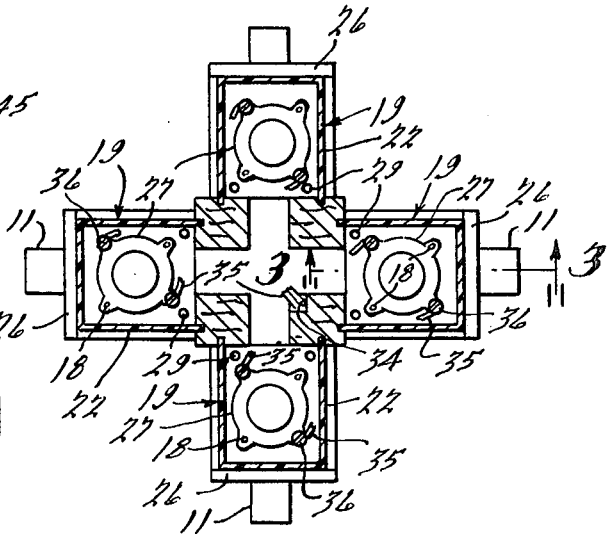
FIG. 2 is an enlarged sectional view of the structure illustrated in FIG. 1, taken on the line 2—2 thereof.

A lamp in accordance with the present invention comprises a central core made from four like square lengths of wood 10 which are spaced apart in a rectangular array by crossed elements 11 of wood. The elements 11 have a top surface 12, a bottom surface 13, and sloping ends 14. The central areas 15 of the elements 11 are notched to receive a top plate 17 and a bottom plate 18 of an illuminating unit 19. Since the extending portions of the elements 11 are at right angles to each other, four illuminating units may be supported thereby. In FIG. 3, the unit 19 has the top plate 17 nailed or otherwise secured to the underface of the top element 11 while the bottom 18 is nailed or otherwise secured to the top face of the bottom element 11 in aligned relation to each other. Each of the plates 17 and 18 is notched at the front at 21.

A translucent U-shaped cover element 22 of plastic material is employed for enclosing a lamp bulb 23 supported on the plate 18. The plates 17 and 18 contain a pair of saw cuts 24 which join a pair of vertical slots 25 in the adjacent core elements 10. The U-shaped plastic element 22 slides within the slots 24 and into the slots 25 so as to be in substantially sealed relation about the bulb 23. A pair of locking elements 26 are nailed or otherwise secured within the notches 21 across the top and bottom front face of the U-shaped element 22 to form the illuminated unit. A standard socket 27 is secured by a pair of screws 28 to the bottom plate 18 of the unit into which the bulb 23 is screwed in conducting relation therewith.

To provide ventilation for the bulb 23 a pair of apertures 29 are disposed through the plates 17 and 18 adjacent to the surface of the core elements 10. A piece of screen 31 is placed over the apertures on the outside of the plates 17 and 18 retained in position by a thin strip of wood 32 having a pair of apertures 33 therethrough aligned with the apertures 29. The screen prevents any insects from getting into the illuminating unit which could affect the light from the bulb 23. A vertical notch 34 is provided along an inner corner of one of the elements 10 in which a pair of wires 35 are secured. The wires are connected to screws 36 of the socket 27. Each of the wires is secured to a socket 27 by a screw 36 so as to have the wiring to each of the sockets disposed in parallel relation so as to deliver full current to each of the bulbs 23.

Figure 5:
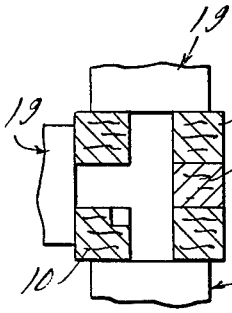
FIGS. 5, 6 and 7 are sectional views of the central supporting elements of the lamp for one, two or three illuminating units with the space between the square corner elements filled by blocks of wood to seal the central portion of the lamp.
Figure 6:
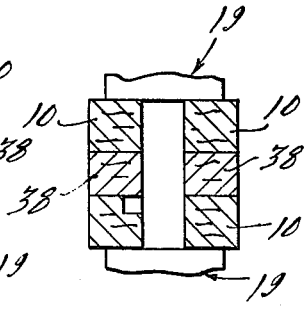
Figure 7:
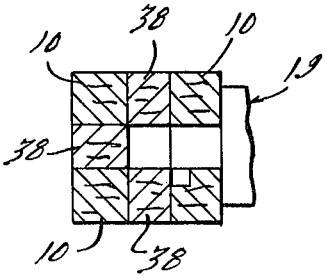

When a single illuminating unit 19 is supported by the core elements 10, as illustrated in FIG. 7, three blocks of wood 38 are employed for filling the area between the core elements 10 not covered by the unit 19. In FIG. 6, a pair of units 19 are supported by the four core elements 10 and similar blocks 38 are employed for filling the two areas between the blocks not occupied by the units. In FIG. 5, three units 19 are illustrated requiring only one block 38 to fill the space between two of the core elements 10 which are not covered by a unit 19. In this manner, the units are fully protected by having the spaces between the core elements 10 enclosed. In FIG. 8, the parallel connection of the sockets 27 is illustrated produced by conductors 39 which are substituted for the conductors 35.

In FIG. 4, a further connection is illustrated between the units 19 and a base 41 which may be supported on a table or which may be a pedestal supporting the lamp from the floor. The base could also contain a second lamp in case a plurality of lamps are to be utilized. In the present arrangement, a square or round base 42 is attached to the bottom extensions 43 of the core elements 10. The crossed elements 44 and 45 have the element 44 thicker at 46 at the top so as to fit within the greater width 47 provided at the bottom 48 of the adjacent elements 10. This assures the alignment of the prongs 49 extending from a male plug 51 with the slots in the plug 52, both of which are secured in the central area between the four core elements 10. A pair of conductors 43 extends through the base 42 and are secured within the recess 34 in one of the elements 10 and to the male plug 51 carried by the base. The joining of the conductors of the plugs 49 and 51 completes a circuit from the conductors 53 to the sockets 27. Assurance is thus provided that the prongs 49 will extend within the slots in the female plug 51 when the lamp is assembled on the base or pedestal. The length of the elements 11 where the illuminating units 19 are omitted may be shortened as they do not support the plates 17 and 18 thereof.

What is claimed:

1. A modular lamp having a central core comprising four like vertically extending core members disposed in a rectangular array, a pair of cross members spacing said vertical members from one another and extending outwardly therefrom, and a plurality of illuminating units having base and top plates secured to the upwardly and downwardly facing surfaces of the extending portions of said cross members, respectively, a plurality of U-shaped translucent plastic elements supported between the base and top plates in aligned slots in the base and top plates for partially enclosing said illuminating units, respectively, and means in said core for receiving a pair of electrical conductors.

2. A lamp as recited in claim 1, wherein a male and female plug are mounted centrally between the four core members to facilitate stacking of a plurality of said lamps.

* * * * *